US005158214A

United States Patent [19]

Volpe et al.

[11] Patent Number: 5,158,214

[45] Date of Patent: Oct. 27, 1992

[54] SOLDER PASTE APPLICATOR AND MIXING TOOL

[75] Inventors: John Volpe, Milford, Mass.; Ira G. Elias, Johnston, R.I.

[73] Assignee: JNJ Industries Inc., Milford, Mass.

[21] Appl. No.: 667,468

[22] Filed: Mar. 11, 1991

[51] Int. Cl.[5] ..... B67D 5/06

[52] U.S. Cl. ..... 222/191; 222/386; 222/393; 206/219; 30/128

[58] Field of Search ..... 222/386, 325, 326, 80, 222/136, 191, 393; 206/219; 30/125, 128

[56] References Cited

U.S. PATENT DOCUMENTS

| | | | |
|---|---|---|---|
| 233,202 | 10/1880 | Cheney | 30/128 |
| 335,390 | 2/1886 | Silbermann et al. | 30/128 |
| 1,274,452 | 8/1918 | Richards, Jr. | 222/393 |
| 1,337,743 | 4/1920 | Bailey | 222/393 X |
| 1,373,935 | 4/1921 | Bailey | 222/393 X |
| 1,998,692 | 4/1935 | Van Rossem et al. | 222/136 |
| 2,435,805 | 2/1948 | Tanner | 30/128 |
| 3,140,078 | 7/1964 | Krahe et al. | 222/386 X |
| 3,144,966 | 8/1964 | Cook | 222/136 |
| 3,153,531 | 10/1964 | Cook | 222/136 |
| 3,164,303 | 1/1965 | Trautmann | 222/136 X |
| 3,195,778 | 7/1965 | Coates | 222/80 |
| 3,543,967 | 12/1970 | O'Connor | 222/386 X |
| 4,371,094 | 2/1983 | Hutter, III | 222/136 X |
| 4,664,299 | 5/1987 | Goncalves | 222/386 X |
| 4,744,494 | 5/1988 | Seager et al. | 222/326 X |
| 4,776,704 | 10/1988 | Kopunek et al. | 222/386 X |
| 4,799,801 | 1/1989 | Brüning | 222/136 X |
| 4,966,468 | 10/1990 | Brüning | 222/386 X |

FOREIGN PATENT DOCUMENTS

| | | | |
|---|---|---|---|
| 311030 | 5/1929 | United Kingdom | 222/393 |

*Primary Examiner*—Michael S. Huppert
*Assistant Examiner*—Anthoula Pomrening
*Attorney, Agent, or Firm*—Samuels, Gauthier & Stevens

[57] ABSTRACT

A solder paste applicator for dispensing a tin/lead solder in a uniform, homogeneous fashion. The solder paste applicator comprises both a mixing assembly and a plunger assembly. The mixing assembly mixes the solder until it is homogeneous and the plunger assembly is used to dispense the solder. The solder paste applicator has a tubular section, a trough section terminating in a scoop, and a collar received at the intersection of the tubular section and the trough section. The mixing assembly is received in the tubular section and is reciprocated to mix the solder.

6 Claims, 1 Drawing Sheet

SOLDER PASTE APPLICATOR AND MIXING TOOL

BACKGROUND AND BRIEF SUMMARY OF THE INVENTION

In surface mount technology, a bead of solder, typically tin/lead with a resin flux, is applied to a screen/-stencil as a continuous bead line which bead line is subsequently squeegeed onto the board in a separate operation. Applying a uniform, homogeneous, continuous bead is difficult because of the high viscosity of the solder. Also, the solder tends to separate if stored for any length of time. Cartridges are available to dispense the solder, such as with a caulking gun. Most users prefer to buy the solder paste in jars containing 100 g, 250 g, 500 g or 1000 g and then simply mix the solder prior to use.

Broadly the invention comprises a solder paste applicator which cooperates with both a mixing assembly and a plunger assembly. The applicator has a dispensing end and an acquisition/mixing end. The acquisition/-mixing end is used to mix solder in the container in which it is sold and to transfer the solder from the container to the applicator. The dispensing end applies a uniform bead of solder. If the solder in the applicator is homogeneous then the plunger assembly is used to dispense the solder. If the solder in the applicator is not homogeneous then the mixing assembly is first used and then the plunger assembly is used.

The invention broadly comprises an applicator having a tubular section and a trough section. The tubular section terminates in a dispensing tip at one end of the applicator and the trough section terminates in a scoop at the other end of the applicator. A collar is slideably received over the applicator where the tubular section and trough section are joined.

The mixing assembly is received in the tubular section and reciprocated to mix the solder. The plunger assembly is received in the tubular section and a plunger extrudes the solder from the dispensing tip. The solder is dispensed as a uniform, homogeneous bead onto a screen/stencil. Thus, the prior art problems of a homogeneous solder dispensed in a uniform bead are overcome in a simple and expedient manner.

DESCRIPTION OF THE PREFERRED EMBODIMENT(S)

Figure 1:
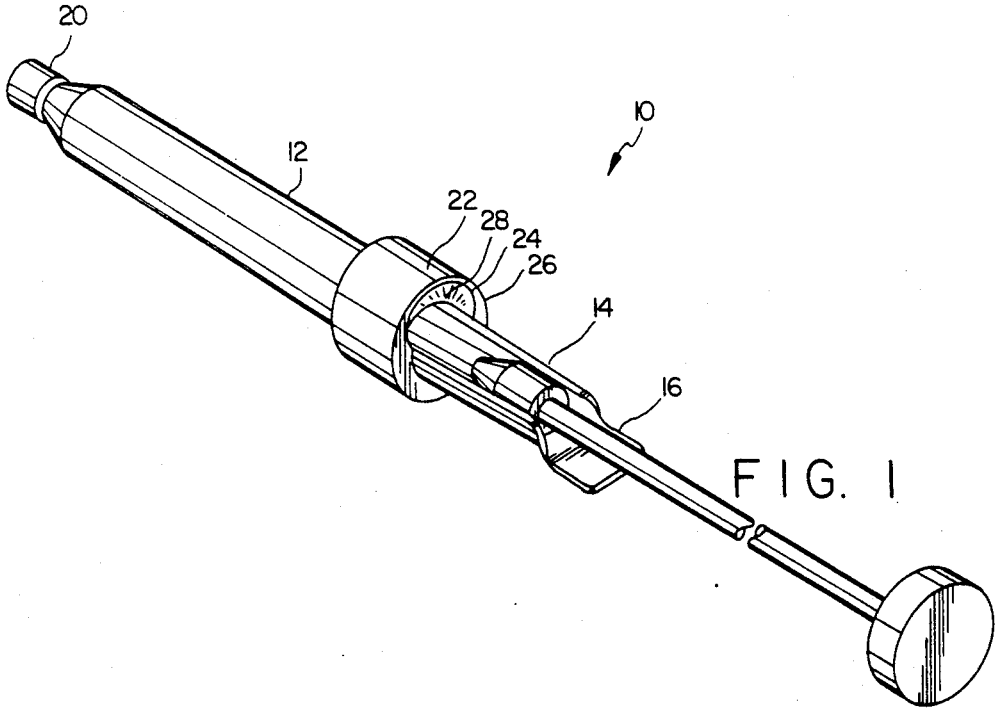
FIG. 1 is a perspective view of a solder paste applicator embodying the invention.

Referring to FIG. 1, the solder paste applicator 10 comprises a tubular section 12 formed integrally with a trough section 14. The trough section 14 terminates in an extending scoop 16. The tube section 12 terminates in a threaded dispensing end 18 and includes a threaded cap 20.

A collar 22 is received over the tube at the juncture of the trough section 14 and the tubular section 12 to prevent solder from spilling out of the applicator 10 when being used.

Initially, the scoop 16 is used to mix and remove solder from a container. The scoop is shaped bill-like to facilitate mixing and removal of the solder in and from the container. After sufficient solder has been removed from the container, if it is homogeneous, then the tubular section 12 is filled with the solder by any suitable technique. Subsequently, the plunger assembly is used to dispense the solder.

Figure 2:
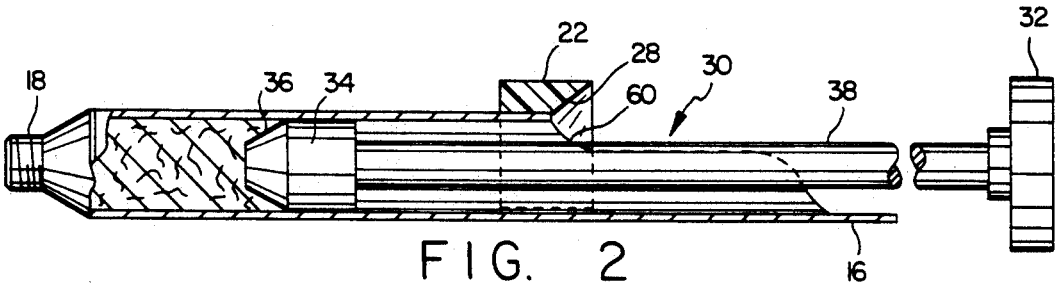
FIG. 2 is a side view of the paste plunger assembly.

Referring to FIG. 2, the plunger assembly is shown at 30 and comprises a handle 32 joined to a plunger 34, having a frustoconical end 36, by a shaft 38. In use, the plunger is inserted into the tubular section 12, the threaded cap 20 is removed and with the application of substantially uniform pressure a uniform homogeneous bead of solder is dispensed. The frustoconical end 36 mates with the frustoconical dispensing end of the tubular section 12.

As shown in FIG. 1, the arcuate collar 22 includes an inner wall 24 and an outer wall 26 and a bevelled surface 28 formed on its upper edge.

Figure 3:
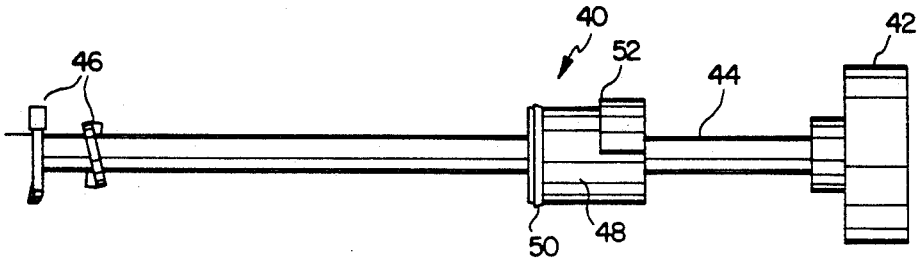
FIG. 3 is a side view of the paste mixer assembly.

Referring to FIG. 3, a mixing assembly 40 is shown and comprises a handle 42 joined to a shaft 44. At the end of the shaft 44 are mixing blades 46, such as two 30° mixing blades which are 45° off axis formed integrally therewith. A plug 48 includes an O-ring 50 and is slideably received on the shaft 44. The plug 50 includes a stepped surface 52.

The collar 22 is placed on the applicator 10 with the surface 28 adjacent the edge 60 of the section 12 where the trough joins the tubular section. The mixing assembly 40 is placed into the tubular section 12. The plug 48 slides down the shaft 44 until its stepped surface 52 engages the edge 60. The plug 48 is held in place during mixing while the shaft is reciprocated. The collar 22 is used to contain any solder that may pass by the O-ring during mixing. The O-ring is to ensure that during mixing the solder does not move out of the chamber. With the threaded cap 20 in place, the shaft is moved inwardly and outwardly with twisting to mix the solder.

After the solder has been mixed, the mixing assembly is removed. The plunger is inserted into the tubular chamber with the collar in place to prevent inadvertent spilling of the solder from the chamber. The threaded cap 20 is removed and by the application of pressure, the plunger extrudes the solder from the end. The walls of the plunger slideably engage the inner walls of the chamber and as shown the plunger is frustoconical and mates with the dispensing end to ensure that all the solder is extruded.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A solder paste applicator which comprises:

a tubular section and a trough section formed integrally therewith, the tubular section terminating in a dispensing nozzle at one end of the applicator and the trough section terminating in a scoop at the other end of the applicator, the scoop extending upwardly and outwardly from the floor of the trough section;

an arcuate collar received on the applicator, the collar including an outer wall having an upper edge and an inner wall having an upper edge, at least a portion of the upper edge of the inner wall recessed with reference to the upper edge of the outer wall to define a bevelled surface, the collar received on the applicator such that said bevelled surface extends over the trough section; and means received in the tubular section to move solder within said tubular section.

2. The applicator of claim 1 wherein the dispensing nozzle is threaded and which comprises:

a cap to engage said threaded nozzle.

3. The applicator of claim 1 wherein the means received in the tubular section comprises a plunger assembly, said assembly comprising a plunger at one end of a shaft and a handle at the other end of the shaft, the plunger adapted to extend fully into the tubular section.

4. The applicator of claim 3 wherein the dispensing nozzle is joined to a frustoconical section formed at the end of the tubular section and the plunger is a frustoconical plunger and is received in the corresponding section in the tubular section in mating relationship.

5. The applicator of claim 1 wherein the means received in the tubular section comprises a mixing assembly, the mixing assembly comprising mixing blades formed integrally at one end of a shaft, a handle formed at the other end of the shaft and a plug slideably received thereon.

6. The applicator of claim 5 wherein the plug is cylindrical in shape and includes an o-ring which engages the inner surface of the tubular section to prevent solder from flowing from the tubular section past the plug, the plug having an outer wall which includes a stepped surface, said stepped surface engaging an upper edge of the tubular section and an upper edge of the trough section to locate the plug in the applicator.

* * * * *